US006892910B2

(12) United States Patent
Capuano et al.

(10) Patent No.: US 6,892,910 B2
(45) Date of Patent: May 17, 2005

(54) CLAMP-TYPE GARMENT HANGER

(75) Inventors: James Capuano, Middle Village, NY (US); Steven J. Sutton, Brooklyn, NY (US)

(73) Assignee: The Accessory Corporation, New York, NY (US)

( * ) Notice: Subject to any disclaimer, the term of this patent is extended or adjusted under 35 U.S.C. 154(b) by 0 days.

(21) Appl. No.: 10/413,697

(22) Filed: Apr. 15, 2003

(65) Prior Publication Data

US 2004/0206788 A1 Oct. 21, 2004

(51) Int. Cl.[7] ..... A41D 27/22
(52) U.S. Cl. ..... 223/96
(58) Field of Search ..... 223/85, 96; D6/315

(56) References Cited

U.S. PATENT DOCUMENTS

| | | | | | |
|---|---|---|---|---|---|
| D222,513 | S | * | 10/1971 | Hart et al. | D6/315 |
| 4,395,799 | A | | 8/1983 | Batts | 24/137 A |
| 4,438,874 | A | | 3/1984 | Zuckerman et al. | 223/88 |
| 4,714,183 | A | | 12/1987 | Tontarelli | 223/91 |
| 4,759,480 | A | * | 7/1988 | Duester et al. | 223/96 |
| 4,828,155 | A | | 5/1989 | Louw | 223/85 |
| 4,884,727 | A | | 12/1989 | Blanchard | 223/93 |
| 4,901,893 | A | | 2/1990 | Conran et al. | 223/66 |
| 5,062,556 | A | | 11/1991 | Willputz | 223/96 |
| 5,212,854 | A | | 5/1993 | Hollis | 24/487 |
| 5,398,854 | A | | 3/1995 | Blanchard | 223/96 |
| 5,562,237 | A | * | 10/1996 | Saliaris | 223/96 |
| D410,793 | S | | 6/1999 | Gouldson | D6/315 |
| 6,029,869 | A | | 2/2000 | Rice | 223/88 |
| 6,047,867 | A | * | 4/2000 | Heiber | 223/96 |

* cited by examiner

*Primary Examiner*—John J. Calvert
*Assistant Examiner*—James G Smith
(74) *Attorney, Agent, or Firm*—Gordon & Jacobson, PC

(57) ABSTRACT

A garment hanger includes a hook member and at least one clamp member coupled to a top crossbar member. At least one gripping finger is provided having a portion that is resiliently biased in a close spatial arrangement with a surface (preferably the top surface) of a bottom crossbar member. An end of the gripping finger is angled upward from the surface of the bottom crossbar member to facilitate insertion of the garment therebetween. The clamp member is used to engage and support a garment, such as a pair of pants. The gripping finger(s) and the bottom crossbar member are used to grasp and hold the garment therebetween. Together, these elements can be used to reduce the vertical dimension of the garment held by the garment hanger.

19 Claims, 6 Drawing Sheets

CLAMP-TYPE GARMENT HANGER

BACKGROUND OF THE INVENTION

1. Field of the Invention

The present invention relates to clamp-type garment hangers.

2. State of the Art

Clamp-type garment hangers having at least one clamp are well-known for the suspension or hanging of garments such as pants, skirts, etc. The "pinch-type" clamp is a variety of clamp that has a clamp end having a pair of opposed clamp or jaw members between which a portion of the garment is secured, and a handle portion having a pair of spaced apart handles. Provision is made for biasing the jaw members towards each other to create the clamping force necessary to retain a garment between inner surfaces of the jaw members. The jaw end of the clamp is hinged to the handle portion such that squeezing or pinching the handles toward one another, i.e., to reduce the space between the handles, causes the jaw members to open to receive or release a garment. To further retain the garment between the inner surfaces of the members, the clamp or jaw members typically also include inner surface gripping elements or friction increasing surfaces.

An example of a clamp-type hanger is shown in U.S. Pat. No. 5,398,854 to Blanchard, which describes a hanger with a clamp having a jaw end, a handle portion at an opposite end from the jaw end, and a hinge point between the two ends. The jaw ends are provided with resilient friction pads to engage a garment provided in the clamp. A C-shaped spring clip provides the means for biasing the jaws to a closed position.

Another exemplar clamp-type hanger is shown in U.S. Pat. No. 4,395,799 to Batts. This clamp hanger has two sets of toothed elements on the inside of one of the jaws, which surround a single toothed element on the other of the jaws to secure a garment in the clamp of the hanger.

While the known clamp-type hangers are useful in holding a variety of garments, long garments (such as pants) typically extend far below the garment hanger. This requires that a display rack that showcases such garments provide a large vertical dimension. The large vertical dimension limits the number of articles that can be made readily visible and presented to the customer for a given amount of wall space/display space. In addition, the large vertical dimension limits the suitability of the clamp-type hanger in space-limited environments such as shipping containers.

Thus, there remains a need in the art to provide an improved clamp-type garment hanger that enables a reduction in the vertical dimension of a garment held by the garment hanger.

SUMMARY OF THE INVENTION

It is therefore an object of the invention to provide a clamp-type garment hanging device which enables retailers to reduce the vertical dimension of a garment, such as pants, held by the garment hanging device.

It is another object of the invention to provide a clamp-type garment hanging device which enables retailers to readily display and present a large number of garments for a given amount of wall or display space.

It is a further object of the invention to provide a clamp-type garment hanging device which enables retailers to readily display and present a large number of garments in a space-limited environment, and to ship more articles on hangers in a given container space.

It is an additional object of the invention to provide a clamp-type garment hanging device that enables a retailer to neatly and compactly display and present a garment to a potential customer.

In accordance with the present invention, a garment hanging device includes a hook member and at least one clamp member coupled to a top crossbar member. At least one gripping finger is provided having a portion that is resiliently biased in a close spatial arrangement with a surface (preferably the top surface) of a bottom crossbar member. An end of the gripping finger is angled upward from the surface of the bottom crossbar member to facilitate insertion of the garment therebetween. The clamp member is used to engage and support a garment, such as a pair of pants. The gripping finger(s) and the bottom crossbar member are used to grasp and hold the garment therebetween. Together, these elements can be used to reduce the vertical dimension of the garment held by the garment hanger. This enables a retailer to neatly and compactly display and present a garment to a potential customer. Moreover, it enables a garment display rack to securely showcase a larger number of articles than was previously possible, and to ship more articles on hangers in a given container space.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1A:
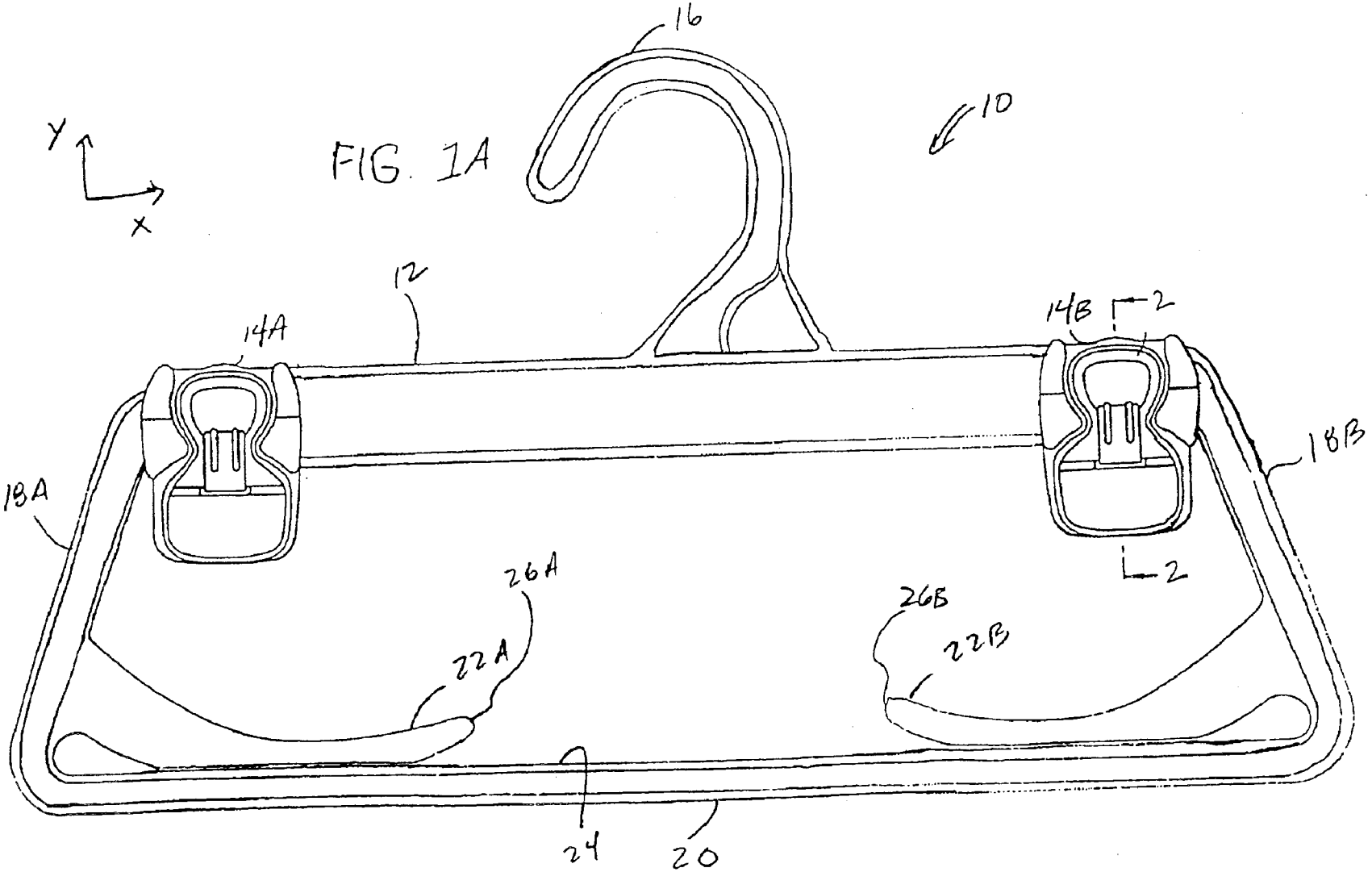
FIG. 1A is a front view of a first embodiment of a clamp-type garment hanger in accordance with the present invention.

Referring now to FIG. 1A, a garment hanger 10 includes an upper crossbar section 12 having pinch-type clamps 14A, 14B preferably disposed at or near the ends of the upper cross-bar section 12 as shown. Garment hanger 10 includes a partial loop or hook member 16, which may be formed from plastic or metal wire or any other appropriate material. The partial loop or hook member 16 may be integrally formed from the same material as the upper crossbar section 12 as shown, may be a wire secured via threads to the section 12, or may be connected to the section 12 in any other manner. The hook member 16 is used to hang the garment hanger 10 from a support, such as a bar or wire mesh or other support structure as is well known. As described below with respect to FIGS. 2A through 2C, the clamps 14A, 14B each include a fixed jaw and moveable jaw that are resiliently biased in a close spatial arrangement relative to one another by a spring clip. The jaws are used to engage and support a garment, such as a pair of pants.

Figure 3:
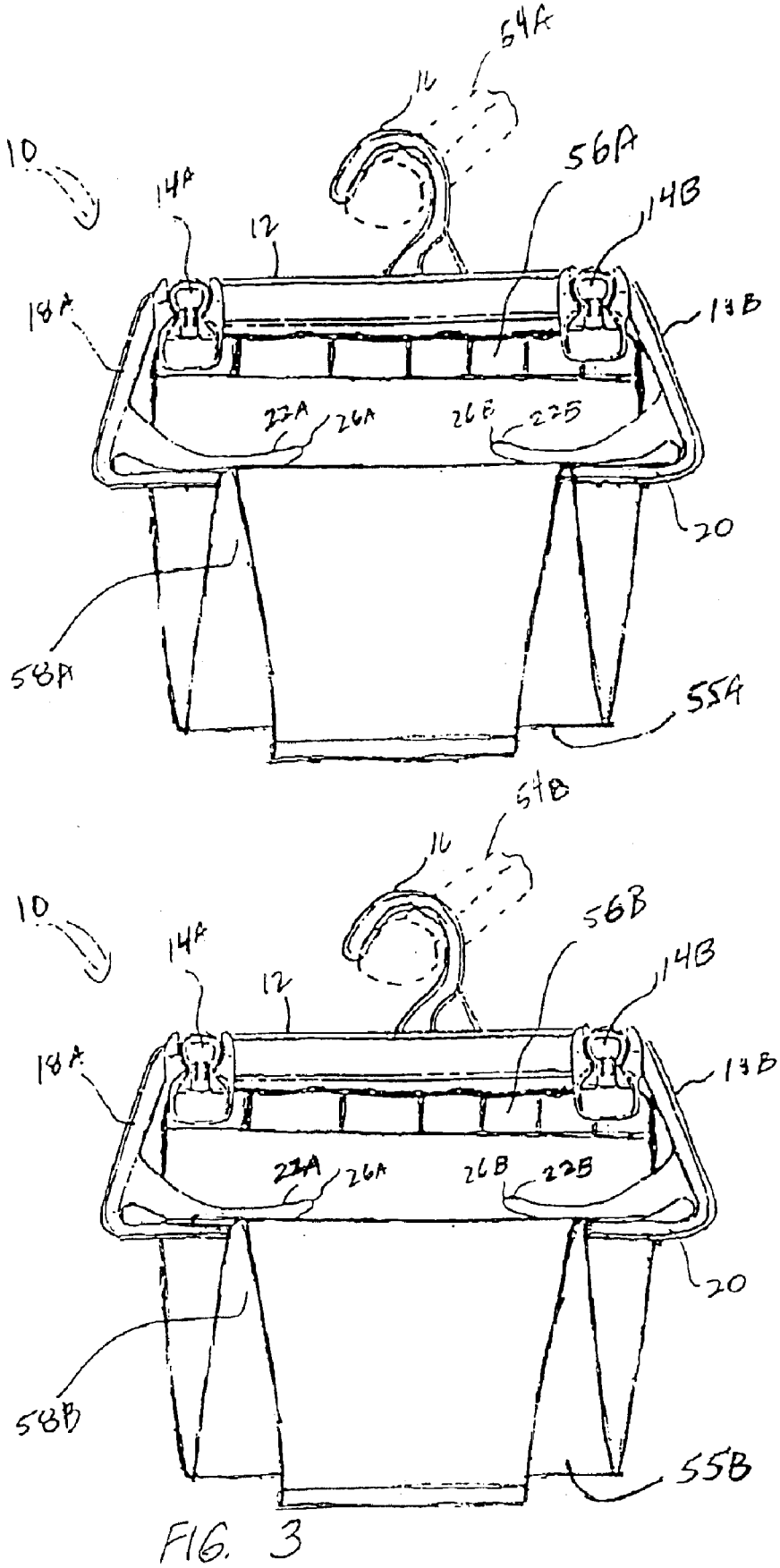
FIG. 3 is a front view of a display rack in which two exemplary hangers of FIG. 1A are used to hang two pairs of pants one under the other in the same vertical space normally required to hang one pair of pants.

Side supports 18A, 18B extend downward from the ends of the upper crossbar section 12 to a lower crossbar section 20. Preferably, the width of the lower crossbar section 20 is greater than the width of the upper crossbar section 12 such that the side supports 18A and 18B are angled with respect to the vertical axis Y as shown. A pair of gripping fingers 22A, 22B extend from the side supports 18A and 18B, respectively. Portions of the gripping fingers 22A, 22B are resiliently biased in a close spatial arrangement with the top edge 24 of the lower crossbar section 20 as shown. Preferably, this spatial arrangement is designed such that the fingers 22A, 22B engage a pair of folded pants (or other garment parts) placed between the gripping fingers 22A, 22B and the top edge 24 of the lower crossbar section 20 (as seen in FIG. 3). The distal ends 26A, 26B of the gripping fingers 22A, 22B are angled upward from the top edge 24 of the lower crossbar section 20 to facilitate insertion of the folded pants or other garment parts under the gripping fingers 22A, 22B (as seen in FIG. 3).

Preferably, the hook 16, the upper crossbar section 12, the fixed jaw of the clamps 14A, 14B, the side supports 18A, 18B, the lower crossbar section 20, and the gripping fingers 22A, 22B are molded unitary and integral to one another. Preferably these elements, along with the moveable jaw of claims 14A and 14B, are formed by molding any one of a number of well known plastic or resin materials, such as "k"-resin, polystyrene, polypropylene, polyethylene, styrene-butadiene copolymers and blends, polycarbonates, and combinations thereof.

Figure 1B:
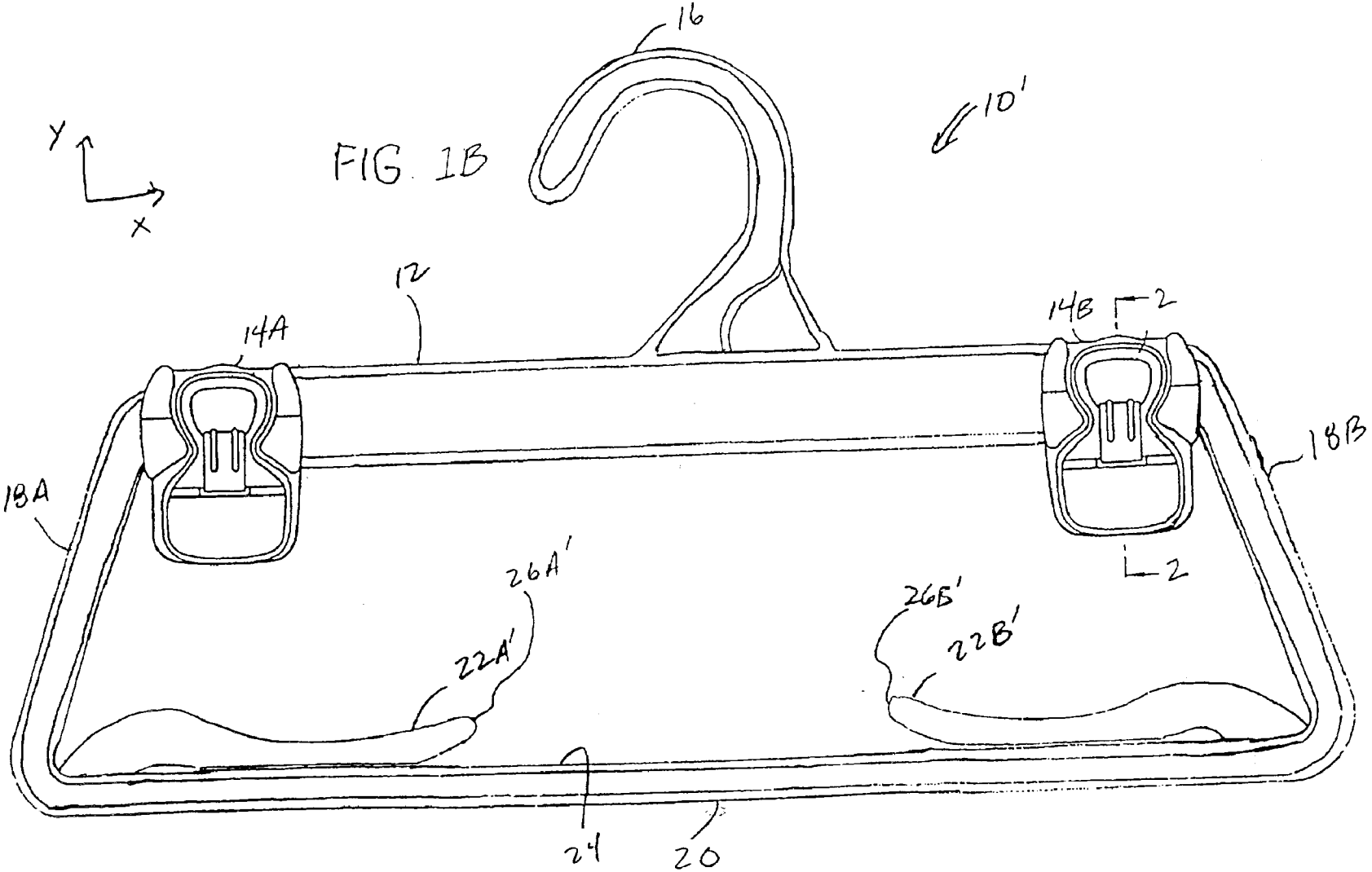
FIG. 1B is a front view of a second embodiment of a clamp-type garment hanger in accordance with the present invention.
Figure 1C:
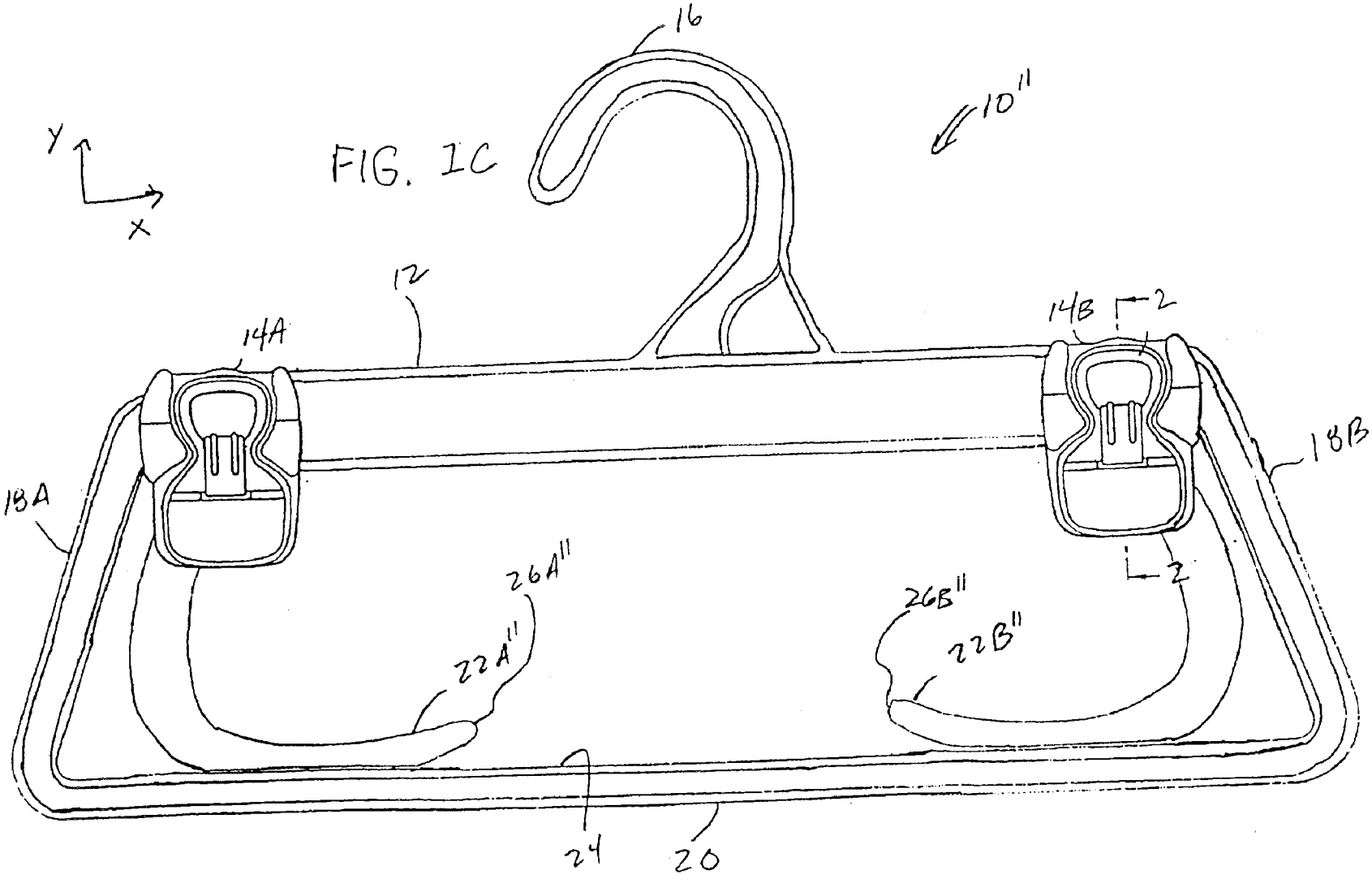
FIG. 1C is a front view of a third embodiment of a clamp-type garment hanger in accordance with the present invention.

In alternate embodiments, the gripping fingers may extend not from the side supports 18A, 18B, but from the bottom crossbar section 20 as shown in FIG. 1B (with gripping fingers 22A', 22B' terminating at ends 26A', 26B') or the top crossbar section 12 as shown in FIG. 1C (with gripping fingers 22A", 22B" terminating at ends 26A", 26B").

Figure 1D:
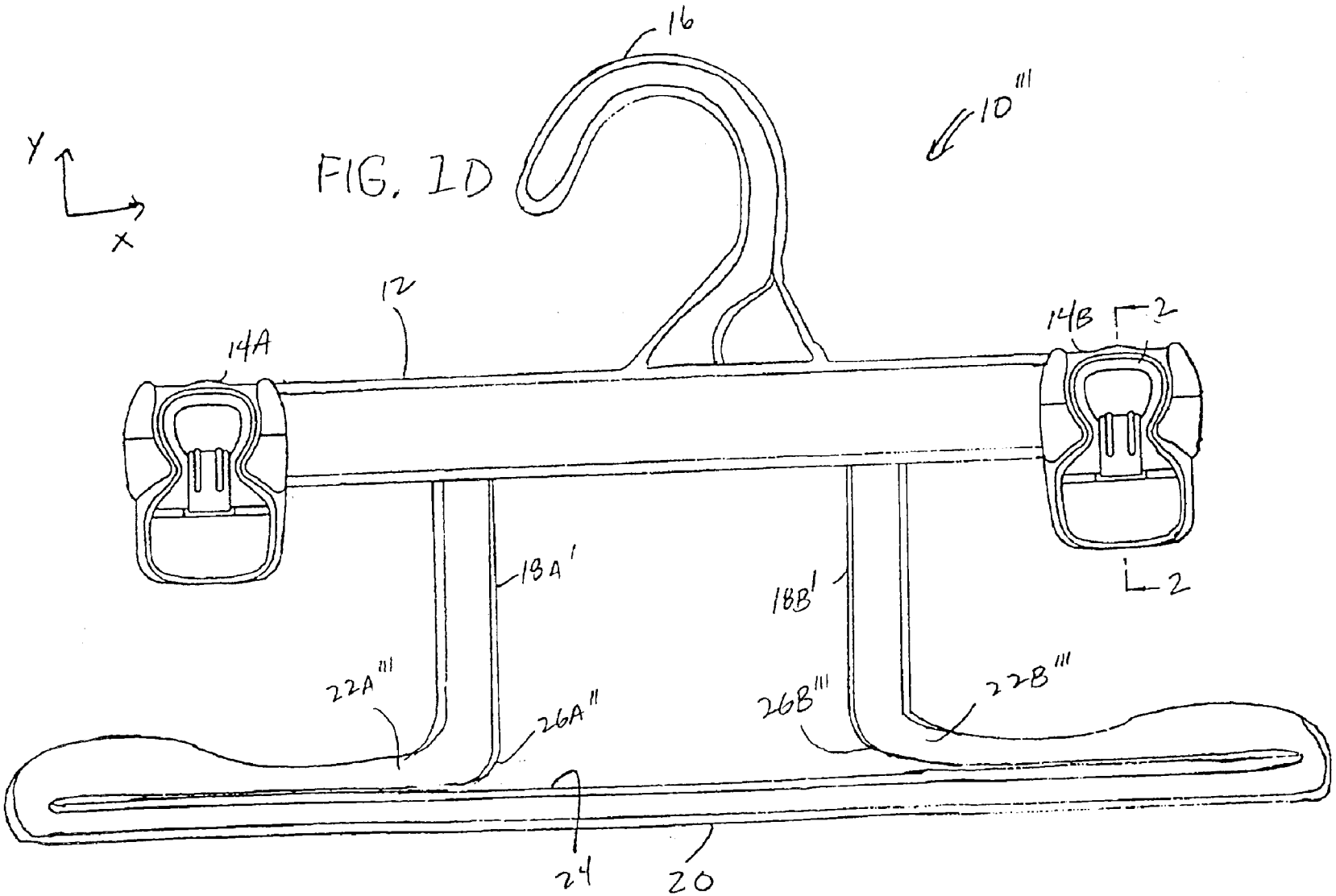
FIG. 1D is a front view of a fourth embodiment of a clamp-type garment hanger in accordance with the present invention.

In another alternative embodiment as shown in FIG. 1D, support members 18A' and 18B' extend downward from the top crossbar member 12 to ends 26A'", 26B'" of gripping fingers 22A'", 22B'" that are disposed near the middle of the bottom crossbar member 20 as shown. The opposite ends of the gripping fingers 22A'", 22B'" extend to the ends of the bottom crossbar member 20. Portions of the gripping fingers 22A'", 22B'" are resiliently biased in a close spatial arrangement with the top edge 24 of the lower crossbar section 20 as shown. Preferably, this spatial arrangement is designed such that the gripping fingers 22A'", 22B'" engage a pair of folded pants (or other garment parts) placed between the gripping fingers 22A'", 22B'" and the top edge 24 of the lower crossbar section 20. Preferably, the "ends" 26A'", 26B'" of the gripping fingers 22A'", 22B'" are angled upward from the top edge 24 of the lower crossbar section 20 to facilitate insertion of the folded pants or other garment types under the gripping fingers 22A'", 22B'".

Figure 2B:
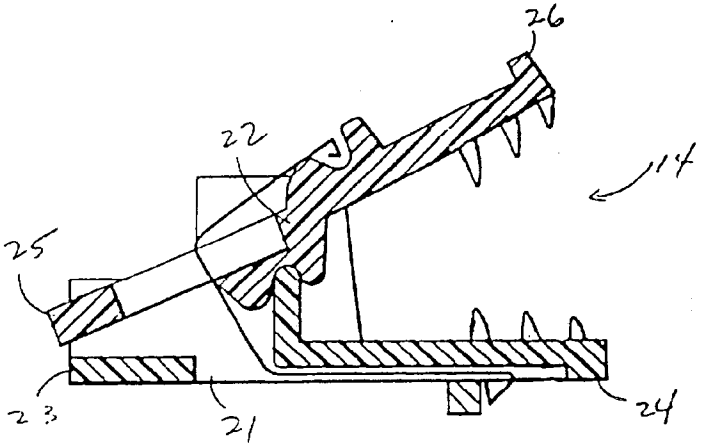
FIGS. 2A, 2B and 2C are sectional views along line 2—2 of the exemplary garment clamp of the garment hanger of FIG. 1 with FIG. 2A showing the garment clamp with its jaw members in a fully closed position, FIG. 2B showing the garment clamp with its jaw members in a fully open position, and FIG. 2C showing the garment clamp with its jaw members shown closed on a portion of a garment.
Figure 2A:
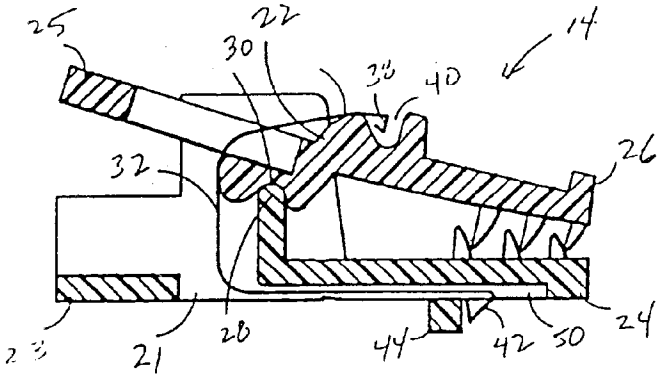
Figure 2C:
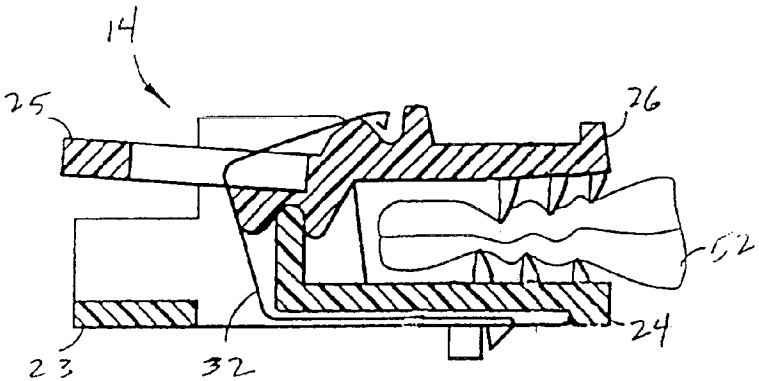

Referring now to FIGS. 2A and 2B, each clamp 14 has a back base member 21 which is preferably integrally formed with the top crossbar section 12, and a front lever member 22 movable relative thereto. The base member 21 includes a handle portion 23 and a jaw end 24. The lever member 22 includes a handle portion 25 which is opposite the handle portion 23, and a jaw end 26 which is positioned opposite the jaw end 24. The lever member 22 is pivotally supported on the base member 21 along a pivot wall 28 on the base member 21. The pivot wall 28 is received in a pivot groove 30 on the back of lever member 22. A C-shaped spring clip 32, preferably made of metal, is dimensioned to receive a portion of the base member 21 and a portion of the lever member 22 and is positioned over those portions such that facing inner surfaces of the spring clip 32 bear against outwardly facing surfaces of the base member 21 and the lever member 22, respectively. A front end of the spring clip 32 has a flange 38 that engages within an aperture 40 in the lever member 22 to secure the spring clip 32 to the lever member. A rear end of the spring clip 32 has a tab 42 which engages a strut 44 spanning an aperture 50 in the base member 21 to secure the spring clip to the base member. The spring clip 32 urges the lever member jaw end 26 towards the base member jaw end 24. The jaws of the lever member 22 and the base member 21 are used to support a garment 52 as shown in FIG. 2C.

The jaws of the clamps of the hanger device are used to engage and support a garment, such as a pair of pants. In addition, the gripping fingers and the bottom crossbar section of the hanger device are used to grasp and hold the garment therebetween. Together, these elements can be used to reduce the vertical dimension of the garment. For example, consider utilizing the exemplary garment hangers described herein to hang two pairs of pants one under the other as shown in FIG. 3. In this case, the hook members 16 of the respective hangers 10 are supported by support members 54A, 54B extending from a vertical post (not shown). The clamps 14A, 14B of the respective hangers are used to grasp onto the waists 56A, 56B of the pants. The pant legs 58A, 58B are neatly folded together and then slid between the gripping fingers 22A and 22B of the hangers such that sections of the folded pant legs overlap one another in the vertical dimension as shown. The gripping fingers 22A and 22B and the bottom crossbar section 20 of each hanger grasp and hold the folded pant leg sections disposed therebetween. In this manner, the vertical dimension of the pants is significantly reduced while maintaining a neat and orderly presentation to the customer. In fact, the hangers with the pants may be placed one under the other and take up the same amount of room as one prior art hanger with one pair of pants.

Advantageously, the garment hanging device of the present invention enables retailers to reduce the vertical dimension of a garment held by the clamp-type garment hanging device. This enables a large number of articles to be readily displayed and presented to potential customers for a given amount of wall or display space. Moreover, it enables a large number of articles to be readily displayed and presented in a space-limited retailed environment, and it enables a large number of articles on hangers to ship in a given container space.

There have been described and illustrated herein embodiments of clamp for a reusable garment hanging device. While particular embodiments of the invention have been described, it is not intended that the invention be limited thereto, as it is intended that the invention be as broad in scope as the art will allow and that the specification be read likewise. Thus, while a particular garment clamping mechanism has been disclosed, it will be appreciated other clamp mechanisms may be used. In addition, while the clamp is shown securely attached to the hanger body as an integral part of hanger body, it will be understood that this attachment method is merely illustrative of the most cost effective method of manufacturing a sturdy, attractive hanger. Furthermore, the clamp may alternatively be made separately from a material that is the same or different from the material of hanger body, and may be fixedly or movably attached to the hanger body by known means or methods. Moreover, the clamp may also be attached to hanger body by one or more intervening elements, such as, for example, a bar or rod (not shown) supported below the hanger body. In addition, while straight crossbar members are shown, it will be appreciated that the term "crossbar" is intended to be broad and include cross members which are curved or otherwise shaped. It will therefore be appreciated by those skilled in the art that yet other modifications could be made to the provided invention without deviating from its spirit and scope as claimed.

What is claimed is:

1. A garment hanger, comprising:

a) a hook member and at least one clamp member coupled to a first crossbar member;

b) a second crossbar member; and c) at least one gripping finger having a portion that is resiliently biased in a close spatial arrangement with a surface of said second crossbar member;

wherein said clamp member has a pair of spring biased jaw members directly opposing one another, wherein at least one jaw member is pivotable relative to the other between open and closed positions.

2. A garment hanger according to claim 1, further comprising:

d) at least one support member that extends downward from said first crossbar to said second crossbar member.

3. A garment hanger according to claim 1, further comprising:

d) at least one support member that extends downward from said first crossbar to said at least one gripping finger.

4. A garment hanger according to claim 1, wherein:

said surface is a top surface of said second crossbar member.

5. A garment hanger according to claim 4, wherein:

an end of said at least one gripping finger is angled upward from said top surface of said second crossbar member.

6. A garment hanger according to claim 1, wherein:

said at least clamp member comprises a plurality of clamp members coupled to said first crossbar member.

7. A garment hanger according to claim 2, wherein:

said at least one support member comprises two side supports; and said at least one gripping finger comprises two gripping fingers that extend from said side supports.

8. A garment hanger according to claim 1, further comprising:

two gripping fingers having portions that are resiliently biased in a close spatial arrangement with said surface of said second crossbar member.

9. A garment hanger according to claim 1, wherein:

said gripping finger extends from said first crossbar member.

10. A garment hanger according to claim 1, wherein:

said gripping finger extends from said second crossbar member.

11. A garment hanger according to claim 1, wherein:

said first crossbar member, said at least one support member, said second crossbar member and portions of said clamp member are molded unitary and integral to one another from a plastic material.

12. A method of hanging a garment comprising the steps of:

a) providing a garment hanger comprising a hook member and at least one clamp member coupled to a first crossbar member, a second crossbar member, and at least one gripping finger having a portion that is resiliently biased in a close spatial arrangement with a surface of said second crossbar member, said clamp member having a pair of spring biased jaw members directly opposing one another, wherein at least one jaw member is pivotable relative to the other between open and closed positions;

b) manipulating said clamp member to grasp onto a first part of said garment; and c) sliding a second part of said garment between said at least one gripping finger and said surface of said second crossbar member, whereby said at least one gripping finger and said surface of said second crossbar member cooperate to grasp onto said second part of said garment.

13. A method of hanging a garment according to claim 12, wherein:

said garment comprises pants, said first part comprises a waist section of said pants, and said second part comprises portions of folded legs of said pants.

14. A method of hanging a garment according to claim 12, wherein:

said garment hanger further comprises at least one support member that extends downward from said first crossbar to said second crossbar member.

15. A method of hanging a garment according to claim 12, wherein:

said garment hanger further comprises at least one support member that extends downward from said first crossbar to said at least one gripping finger.

16. A method of hanging a garment according to claim 12, wherein:

said surface of said garment hanger is a top surface of said second crossbar member.

17. A method of hanging a garment according to claim 16, wherein:

an end of said at least one gripping finger of said garment hanger is angled upward from said top surface of said second crossbar member.

18. A method of hanging a garment according to claim 12, wherein:

said at least clamp member of said garment hanger comprises a plurality of clamp members coupled to said first crossbar member.

19. A method of hanging a garment according to claim 14, wherein:

said at least one support member comprises two side supports; and said at least one gripping finger comprises two gripping fingers that extend from said side supports.

* * * * *